US009358601B2

(12) United States Patent
Bronnhuber et al.

(10) Patent No.: US 9,358,601 B2
(45) Date of Patent: Jun. 7, 2016

(54) METHOD FOR RESHAPING A PLATE-LIKE WORKPIECE

(71) Applicant: TRUMPF Werkzeugmaschinen GmbH + Co. KG, Ditzingen (DE)

(72) Inventors: Thomas Bronnhuber, Stuttgart (DE); Alexander Tatarczyk, Seitingen-Oberflacht (DE)

(73) Assignee: TRUMPF Werkzeugmaschinen GmbH + Co. KG, Ditzingen (DE)

( * ) Notice: Subject to any disclaimer, the term of this patent is extended or adjusted under 35 U.S.C. 154(b) by 240 days.

(21) Appl. No.: 13/868,205

(22) Filed: Apr. 23, 2013

(65) Prior Publication Data

US 2013/0276503 A1 Oct. 24, 2013

(30) Foreign Application Priority Data

Apr. 23, 2012 (DE) ..... 10 2012 206 657

(51) Int. Cl.

| | |
|---|---|
| ***B21D 35/00*** | (2006.01) |
| ***B21D 5/06*** | (2006.01) |
| ***B21D 19/08*** | (2006.01) |
| ***B21D 28/10*** | (2006.01) |

(52) U.S. Cl.

CPC ..... *B21D 35/001* (2013.01); *B21D 5/06* (2013.01); *B21D 19/08* (2013.01); *B21D 28/10* (2013.01)

(58) Field of Classification Search

CPC ..... B21D 11/20; B21D 24/005; B21D 24/16; B21D 31/005; B21D 35/00; B21D 35/001; B21D 35/002; B21D 37/08; B21D 11/08; B21D 11/10; B21D 5/16; B21D 28/10

See application file for complete search history.

(56) References Cited

U.S. PATENT DOCUMENTS

| | | | | |
|---|---|---|---|---|
| 2,359,650 | A | 10/1944 | Kelleher | |
| 4,356,719 | A * | 11/1982 | Sutherland et al. | 72/379.2 |
| 4,444,037 | A | 4/1984 | Norgate | |
| 4,543,811 | A * | 10/1985 | Aoyama | 72/332 |
| 4,852,379 | A * | 8/1989 | Levenberg | B21D 5/16 211/59.3 |
| 5,572,899 | A | 11/1996 | Balaity et al. | |
| 7,490,501 | B2 * | 2/2009 | Endo | B21D 5/01 29/414 |
| 2006/0037378 | A1 | 2/2006 | Lu | |
| 2009/0211326 | A1 * | 8/2009 | Laib | B21D 28/12 72/332 |
| 2010/0001152 | A1 | 1/2010 | Golle et al. | |
| 2013/0205865 | A1 * | 8/2013 | McCallum | 72/384 |

FOREIGN PATENT DOCUMENTS

| | | | |
|---|---|---|---|
| DE | 102006015148 | A1 | 10/2007 |
| EP | 0624411 | A1 | 11/1994 |

OTHER PUBLICATIONS

Murrell, Kenneth (ED)., "Chapter III—Press brakes and their tools", Sheet Metal Industries, 55(1), Fuels and Metallurgical Journals, 1978, pp. 96-106.

* cited by examiner

*Primary Examiner* — Debra Sullivan

(74) *Attorney, Agent, or Firm* — Fish & Richardson P.C.

(57) ABSTRACT

A method of reshaping a portion of a plate-like workpiece lying on a workpiece support of a machine tool, with the workpiece being movable with respect to the workpiece support. The method comprises folding the portion of the workpiece such that the folded portion of the workpiece has several sides and it is only folded at a side connected to a residual portion of the workpiece lying on the workpiece support, and the folded workpiece portion is raised at a predetermined angle with respect to the residual portion, and reshaping the folded portion of the workpiece to have a segment directed downwardly with respect to the folded portion of the workpiece.

14 Claims, 3 Drawing Sheets

METHOD FOR RESHAPING A PLATE-LIKE WORKPIECE

CROSS REFERENCE TO RELATED APPLICATION

Under 35 U.S.C. §119(a), this application claims the benefit of a foreign priority application filed in Germany, serial number 10 2012 206 657.8, filed Apr. 23, 2012, the entire contents of which are hereby incorporated by reference.

TECHNICAL FIELD

The invention relates to a method for reshaping a plate-like workpiece.

BACKGROUND

During manufacturing of components from plate-like workpieces, (e.g., sheet metal) components with a specific outer contour and reshapings on both sides of the surface of the sheet metal often need to be manufactured. Such two-sided manufacture components may be manufactured by progressive tools (e.g., a system including an automatic feeding system that carries a plate-like workpiece past a series of stations each performing a dedicated manufacturing operation on the plate-like workpiece). However, such progressive tools are not flexible and are not efficient for small quantities or small batch sizes.

Another option is to first stamp the contours of the components and subsequently perform the desired reshaping. Related thereto, an elaborate handling of the components is necessary, causing this procedure to involve great effort.

Therefore, to efficiently manufacture such components, manufacturing in a punching machine, or a combined laser punching machine, is desirable. However, regarding open and/or filigree reshapings manufactured by reshaping in a downwards direction, there is a potential problem that these reshapings may be deformed when the sheet metal is moved on a work support of the punching machine or laser punching machine by a collision therewith, so that the component is unusable.

SUMMARY

In some embodiments, a method of reshaping a portion of a plate-like workpiece lying on a workpiece support of a machine tool, the workpiece being movable with respect to the workpiece support, comprises folding the portion of the workpiece such that the folded portion of the workpiece has several sides and it is only folded at a side connected to a residual portion of the workpiece lying on the workpiece support, and the folded workpiece portion is raised at a predetermined angle with respect to the residual portion and reshaping the folded portion of the workpiece to have a segment directed downwardly with respect to the folded portion of the workpiece. The method can comprise separating an outer contour of the folded workpiece from the residual portion at the sides of the folded portion of the workpiece which are not folded. Separating the outer contour of the folded workpiece portion from the residual portion can be performed by punching the workpiece at the sides of the folded portion of the workpiece which are not folded or by laser cutting the workpiece at the sides of the folded portion of the workpiece which are not folded.

In further embodiments, the method can comprise separating the folded workpiece portion from the residual portion after reshaping the folded portion of the workpiece. Separating the folded portion of the workpiece from the residual portion can be performed by punching the workpiece, or performed by laser cutting the workpiece or by creating a micro join connection.

In some embodiments reshaping the folded portion of the workpiece is carried out by a single stroke of the machine tool. Reshaping the folded workpiece portion can comprise moving a lower tool holder upwardly and an upper tool holder downwardly, or an upper tool holder is downwardly moved and a lower tool holder is immovably locked by the machine tool for reshaping. The method can include placing a folding tool into tool holders of the machine tool before folding the portion of the workpiece and placing a reshaping tool different from the folding tool in the tool holders before reshaping the folded portion of the workpiece. The plate-like workpiece can be sheet metal.

Certain methods described herein advantageously provide a reliable process for efficient manufacturing of components having reshapings in the direction of the lower side of a workpiece.

DETAILED DESCRIPTION

Figure 1:
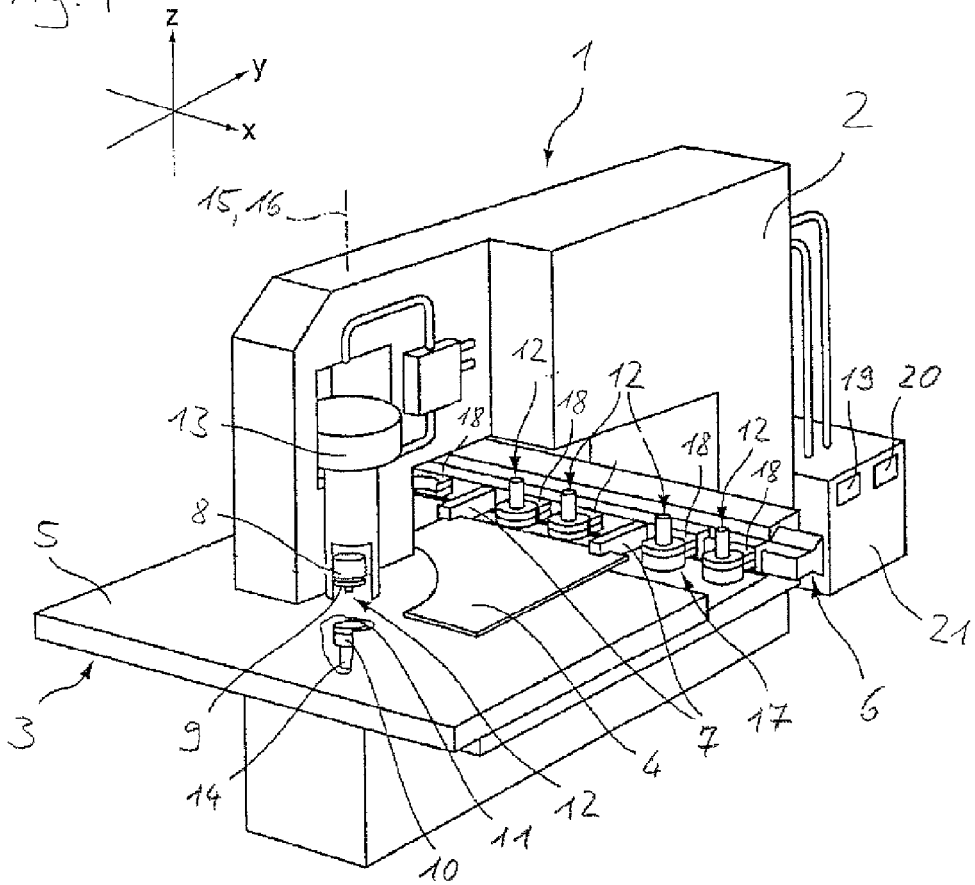
FIG. 1 shows a punching machine as an embodiment of a machine tool.

In FIG. 1, an example of a machine tool 1 for cutting and/or reshaping plate-like workpieces is shown. Here, the machine tool is a punching machine; however, it can alternatively be a laser punching machine, for example. The machine tool 1 includes a C-frame 2 in which a workpiece support formed as a table 3 serves for supporting a workpiece to be processed in the form of a sheet of sheet metal 4. The upper side of the workpiece support 3 serves as a horizontal support plane 5 for the sheet metal 4 to be processed. The support plane 5 is parallel with respect to an x-y-plane in the coordinate system shown in FIG. 1. In this coordinate system a downward direction is defined as being generally in the negative z direction. The sheet metal 4 clamped by chucks 7 is movable in the support plane 5 of the table 3 by a workpiece movement apparatus 6. At the front end of the upper leg of the C-frame 2 is an upper tool holder 8 in which a tool stamp 9 is accommodated. Furthermore, a lower tool holder 10 is provided at the front end of the lower leg of the C-frame 2 and which accommodates a tool die 11. The tool stamp 9 and the tool die 11 form a tool 12 for a separating and/or reshaping processing of the sheet metal 4.

A stamp drive 13 and a die drive 14 respectively form a drive unit of the machine tool 1 in the form of linear drives. The upper tool holder 8 with the tool stamp 9 attached thereto can be lifted and lowered along a stroke axis 15 with respect to the table 3 by the stamp drive 13. The lower tool holder 10 with the tool die 11 accommodated therein can be lifted and lowered along the stroke axis 15 with respect to the table 3 by the die drive 14. Moreover, by a rotation drive (not shown), the upper tool holder 8 and the lower tool holder 10 are rotatable about a tool rotation axis 16.

At the workpiece movement apparatus 6 is a tool magazine 17 holding further tools 12. The tools 12 contained in the tool magazine 17 are respectively held by a tool cassette 18 and are attachable at the upper tool holder 8 or at the lower tool holder 10 as required for processing the sheet metal 4. For processing the sheet metal 4 and during a tool change, the drives of the machine tool 1 are controlled by a control device 21. The control device 21 includes a storage device 19 for storing program data and tool data, and a controller 20 for controlling the lifting, lowering and rotating movement of the upper tool holder 8 and the lower tool holder as well as for controlling the workpiece movement apparatus based on the stored data.

Figure 2:
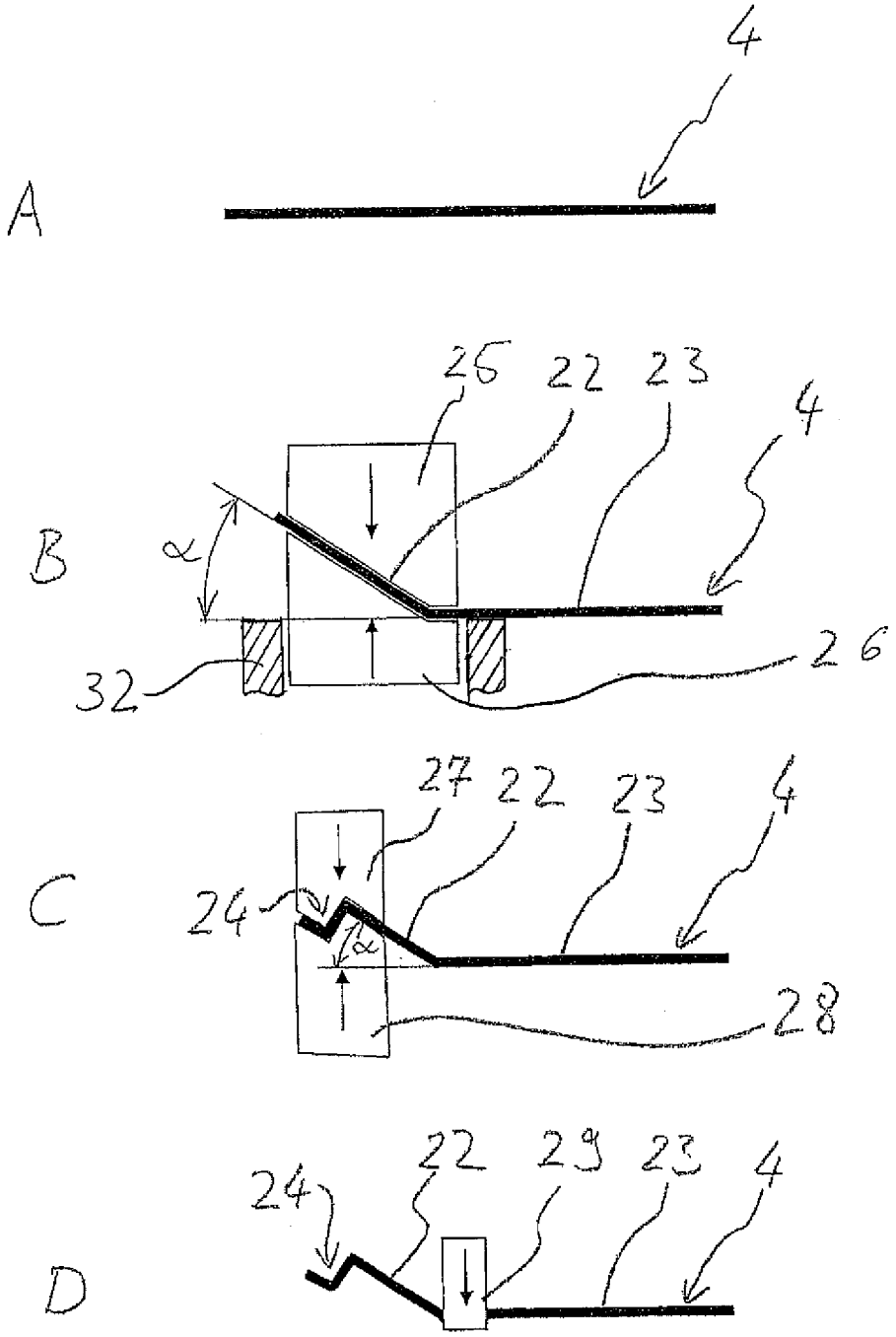
FIG. 2 shows schematic diagrams of a shaping operation of a workpiece.

FIG. 2 shows a schematic diagram of several processing steps carried out on the sheet metal 4 located in the support plane 5 (FIG. 1) as viewed from the side. The method can for example, be applied to the manufacturing of components including folded workpiece portions 22 separated from a strip.

View A shows the sheet metal 4 before processing. The sheet metal lies on the table 3 (not shown in this figure, for clarity) of the machine tool 1 and it is moved by the workpiece movement device 6 such that an area to be processed of the sheet metal 4 is located in the area located between the upper tool holder 8 and the lower tool holder 10 of the machine tool 1 (shown in FIG. 1).

In view B, it is shown how a folding tool having an upper folding tool 25 accommodated in the upper tool holder 8 of the machine tool 1 and a lower folding tool 26 accommodated in the lower tool holder 10 of the machine tool 1 is used. The upper folding tool 25 is downwardly moved and the lower folding tool 26 is upwardly moved to conduct a folding step. By the movements of the upper folding tool 25 and the lower folding tool 26, a portion of the sheet metal 4 is upwardly folded at a predetermined angle $\alpha$ so that a folded workpiece portion 22 is created with respect to a residual portion 23 of the sheet metal 4, and the folded workpiece portion 22 is raised with respect to the residual portion 23. Here, the angle $\alpha$ is a 45 degree angle, however, the angle $\alpha$ can be altered. For example $\alpha$ can be increased to accommodate a subsequent downwardly directed reshaping of the folded workpiece portion 22 so that the downwardly directed reshaping does not collide with the table 3.

In an alternative embodiment, a lower folding tool 26 is accommodated in the lower tool holder and the lower tool holder 10 or the lower folding tool 26 is provided with a spring-loaded ejector 32 upwardly pre-stressed. The pre-stressed ejector 32 encloses the lower folding tool 26. The lower folding tool 26 is accommodated in the lower tool holder 10 such that the pre-stressed ejector 32 protrudes above at least a portion of the lower folding tool 26 and it upwardly pushes the sheet metal above the support plane 5. Thus, the sheet metal slides on the spring-loaded ejector 32 during a movement by the workpiece movement device 6 and it does not have any contact with at least a portion of the lower folding tool 26 so that it is not damaged by the lower folding tool 26.

For reshaping of the sheet metal, the upper folding tool 25 is moved downwardly by the upper tool holder 8 and the sheet metal is pushed downwardly against the pre-stress force of the spring-loaded ejector 32 wherein the lower tool holder and thus the lower folding tool 26 are immovably locked by the die drive. Thereby, the portion of the sheet metal 4 is upwardly reshaped about the predetermined angle $\alpha$ by the relative movement of the upper folding tool 25 with respect to the lower folding tool 26 so that the folded workpiece portion 22 is created with respect to the residual portion 23 of the sheet metal 4, and the folded workpiece portion 22 is raised with respect to the residual portion 23. Here, the angle $\alpha$ is a 45 degree angle, however, the angle $\alpha$ can be altered. For example $\alpha$ can be increased to accommodate a subsequent downwardly directed reshaping of the folded workpiece portion 22 so that the downwardly directed reshaping does not collide with the table 3 or the spring-loaded ejector 32.

View C shows a reshaping step as a further step of the method. In this reshaping step, a reshaping of the folded upper portion 22 is carried out to create a bent portion or downwardly directed reshaped segment 24 which is directed downward with respect to the folded upper portion 22. To carry out this reshaping step, the upper folding tool 25 is replaced in the upper tool holder 8 by an upper reshaping tool 27 and a lower reshaping tool 28 is placed into the lower tool holder 10, replacing lower folding tool 26. The upper reshaping tool 27 is moved downwardly and the lower reshaping tool 28 is moved upwardly so that a downwardly directed reshaped segment 24 directed downwardly with respect to the folded workpiece portion 22 is created during one single stroke. Alternatively, several strokes can be conducted as appropriate, as the case may be, with other reshaping tools. Because the angle $\alpha$ about which the folded workpiece portion 22 is raised is predetermined so that the downwardly directed reshaped segment 24 does not collide with the table 3, the components when moving the sheet metal 4 over the table 3 are prevented from being deformed by a collision therewith. This is advantageous as such a collision might render the components unusable, particularly in the case of open and/or filigree reshapings.

In view D, a cutting-off step is shown as an optional further processing step in which the folded workpiece portion 22 having the downwardly directed reshaped segment 24 is separated from the residual portion 23 of the sheet metal 4. For this purpose, a cutting stamp 29 is placed into the upper tool holder 8 and a die corresponding to the cutting stamp 29 is placed into the lower tool holder. The cutting stamp 29 is downwardly moved and the folded workpiece portion 22 is separated at the fold. Alternatively, the separation may be at a location other than the fold.

Figure 3:
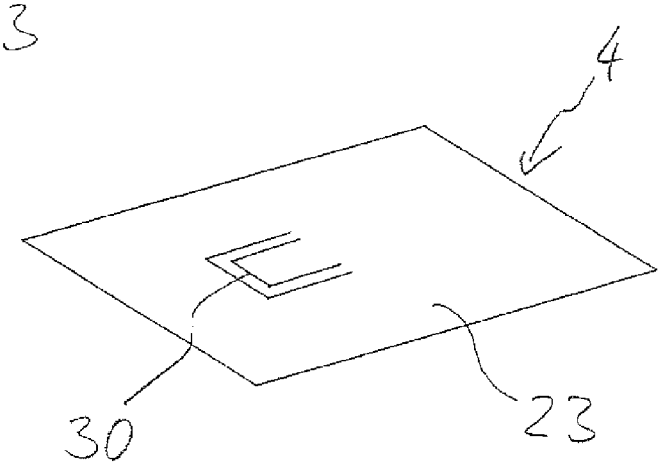
FIGS. 3-5 schematically illustrate a workpiece during different steps of a shaping operation.
Figure 4:
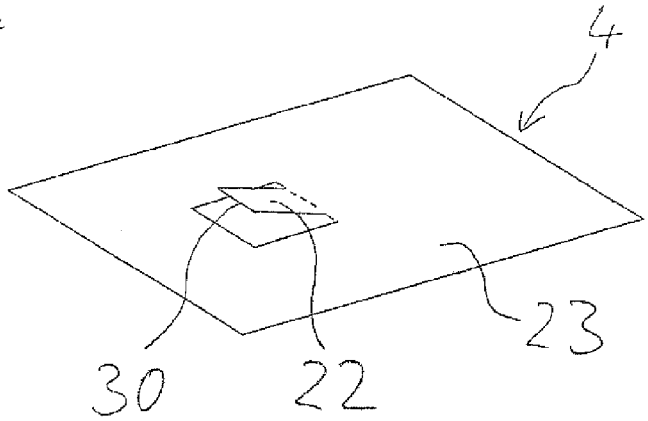
Figure 5:
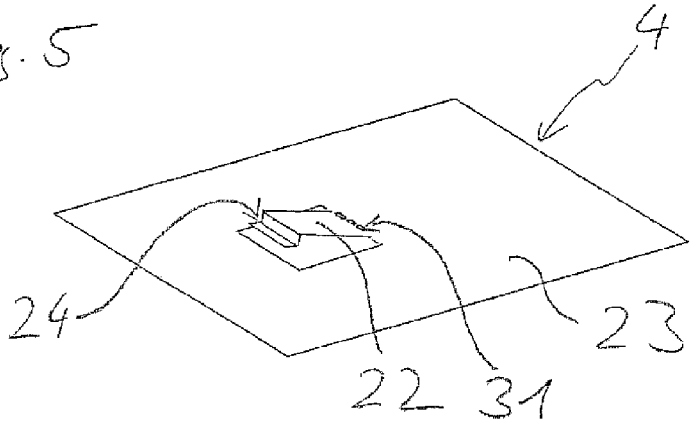

FIGS. 3-5 schematically show the results of an alternative application of the method to a sheet of sheet metal 4 in which the portion of the workpiece being separated is within an area of the sheet metal 4. As shown in FIG. 3, the portion includes an outer contour 30 separated from the residual portion 23 at several sides (here: three) of the portion by a suitable punching tool in a preceding step.

FIG. 4 shows the result of the folding step in which the portion is folded analogously to the folding step shown in FIG. 2 at a side not separated from the residual portion 23. Thus, the folded workpiece portion 22 having the outer contour 30 is created.

As shown in FIG. 5, the downwardly directed reshaped segment 24 has been formed on the folded workpiece portion 22 in the reshaping step. Contrary to the method shown in FIG. 2, the folded workpiece portion 22 is not separated from the residual portion 23 in a cutting-off step but the folded side of the folded workpiece portion 22 is machined such that a micro joint connection or perforation 31 is created. Thus, the folded workpiece portion 22 can be separated from the residual portion 23 later, e.g., by hand. Alternatively, a cutting off by punching or by laser cutting is also possible.

In the present embodiment, the folded workpiece portion 22 is reshaped at one side of the outer contour 30. Reshaping of several sides or of the inner face of the folded workpiece portion 22 and/or punching processing is alternatively possible.

The separation of the sides of the portion from which the folded workpiece portion 22 is created from the residual sheet metal 23 can alternatively be performed by a laser treatment instead of punching. All kinds of outer contours 30 can be flexibly created. Also, the complete separation of the folded workpiece portion 22 from the residual portion 23 or the creation of the micro-joint-connection can happen by a laser treatment.

Usually, the production of the downwardly directed reshaped segment 24 is manufactured by a reshaping tool (such as upper reshaping tool 27 and a lower reshaping tool 28) that is different and distinct from a folding tool (such as upper folding tool 25 and the lower folding tool 26). By performing the method whose steps are illustrated in FIG. 3 to FIG. 5, several folded workpiece portions 22 can be respectively created or processed in differing processing steps. Thus, an economic production of the components is possible.

A number of embodiments of the invention have been described. Nevertheless, it will be understood that various modifications may be made without departing from the spirit and scope of the invention. Accordingly, other embodiments are within the scope of the following claims.

What is claimed is:

1. A method of reshaping a portion of a plate-shaped workpiece lying on a workpiece support of a machine tool, the portion of the plate-shaped workpiece comprising several sides, and the plate-shaped workpiece being movable with respect to the workpiece support, wherein the method comprises:

placing an upper folding tool in an upper tool holder of the machine tool and a lower folding tool in a lower tool holder of the machine tool;

folding the portion of the plate-shaped workpiece using the upper folding tool and the lower folding tool such that the portion is only folded at a side of the several sides that is connected to a residual portion of the plate-shaped workpiece lying on the workpiece support, and such that the portion is raised at a predetermined angle with respect to the residual portion;

removing the upper folding tool from the upper tool holder of the machine tool and placing an upper reshaping tool in the upper tool holder of the machine tool, and removing the lower folding tool from the lower tool holder of the machine tool and placing a lower reshaping tool in the lower tool holder of the machine tool; and reshaping the portion of the plate-shaped workpiece using the upper reshaping tool and the lower reshaping tool such that the portion comprises a first segment raised at the predetermined angle and a second segment directed downwardly towards the workpiece support with respect to the first segment of the portion of the plate-shaped workpiece and such that a free end of the second segment is directed away from the side of the several sides of the portion that is connected to the residual portion.

2. The method according to claim 1, further comprising separating an outer contour of the portion from the residual portion at one or more of the several sides of the portion along which the portion is not folded prior to folding the portion.

3. The method according to claim 2, wherein separating the outer contour of the portion from the residual portion is performed by punching the plate-shaped workpiece at the one or more of the several sides of the portion along which the portion is not folded.

4. The method according to claim 2, wherein separating the outer contour of the portion from the residual portion is performed by laser cutting the plate-shaped workpiece at the one or more of the several sides of the portion along which the portion is not folded.

5. The method according to claim 1, further comprising separating the portion from the residual portion after folding and reshaping the portion.

6. The method according to claim 5, wherein separating the portion from the residual portion is performed by punching the plate-shaped workpiece.

7. The method according to claim 5, wherein separating the portion from the residual portion is performed by laser cutting the plate-shaped workpiece.

8. The method according to claim 5, wherein separating the portion from the residual portion comprises:

creating a micro-joint connection in the plate-shaped workpiece along which the portion can be separated from the residual portion; and separating the portion from the residual portion along the micro-joint.

9. The method according to claim 1, wherein reshaping the portion of the plate-shaped workpiece is carried out by a single stroke of the machine tool.

10. The method according to claim 1, wherein reshaping the portion of the plate-shaped workpiece comprises moving the lower tool holder upwardly and moving the upper tool holder downwardly.

11. The method according to claim 1, further comprising moving the upper tool holder downwardly, wherein the lower tool holder is immovably locked by the machine tool for reshaping.

12. The method according to claim 1, wherein the plate-shaped workpiece is sheet metal.

13. The method according to claim 1, wherein the second segment of the portion is spaced apart from the residual portion of the plate-shaped workpiece.

14. The method according to claim 1, wherein each of the upper folding tool, the lower folding tool, the upper reshaping tool, and the lower reshaping tool are different tools.

* * * * *